US007462788B2

(12) United States Patent
Miyauchi

(10) Patent No.: US 7,462,788 B2
(45) Date of Patent: Dec. 9, 2008

(54) SWITCH DEVICE

(75) Inventor: Masao Miyauchi, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 401 days.

(21) Appl. No.: 11/273,536

(22) Filed: Nov. 9, 2005

(65) Prior Publication Data

US 2006/0102453 A1 May 18, 2006

(30) Foreign Application Priority Data

Nov. 12, 2004 (JP) ..... 2004-329479

(51) Int. Cl.
*H01H 13/70* (2006.01)

(52) U.S. Cl. ..... 200/5 R

(58) Field of Classification Search ..... 200/556, 200/5 R, 557, 553, 339
See application file for complete search history.

(56) References Cited

U.S. PATENT DOCUMENTS 5,957,273 A * 9/1999 Karasik ..... 200/556
6,686,550 B2 * 2/2004 Seki et al. ..... 200/553
6,774,321 B2 8/2004 Komatsu et al.

FOREIGN PATENT DOCUMENTS

JP 6-79047 11/1994

* cited by examiner

*Primary Examiner*—Edwin A. Leon
(74) *Attorney, Agent, or Firm*—Brinks Hofer Gilson & Lione

(57) ABSTRACT

A switch device includes an operation knob rotatably supported by a case, and switch mechanisms which can convert a switch circuit (not shown) disposed inside the case by performing a rocking operation on the operation knob. A cam member having a cam face which can deliver click feelings to the operation knob is disposed in the case. The switch circuit is converted in conjunction with the rocking operation of the operation knob, and click feelings are created so as to be delivered to the operation knob.

10 Claims, 4 Drawing Sheets

SWITCH DEVICE

BACKGROUND OF THE INVENTION

1. Field of the Invention

The present invention relates to a switch device, and more particularly, to a switch device which operates a contact mechanism and applies click feelings to an operating member in response to the operation of the contact mechanism.

2. Description of the Related Art

A switch device according to the related art will be described with reference to JP-A No. 6-79047. As shown in FIG. 6, the switch device is applicable to a power window switch of an automobile, and performs switching operations by pushing and pulling up an operation knob 52.

First, a housing 51 made of a resin material, the inside of the housing 51 being hollow, is disposed at a lowermost portion of the switch. An upper wall 51*a* of the housing 51 is provided with first and second guide parts 51*b* and 51*c* which protrude upward.

Further, at a portion of the upper wall 51*a* interposed between the first and second guide parts 51*b* and 51*c*, a cam face 51*d* is formed. Click feelings are created corresponding to the shape of the cam face 51*d* as a contact 53*a* of a plunger 53 to be described slides the cam race 51*d*.

Furthermore, the operation knob 52 disposed on the housing 51 is rockably supported by the housing 51 and moves a gripper 52*a* up and down, thereby rotating in clockwise and counter-clockwise directions in FIG. 6.

In the operation knob 52, a boss 52*b* extends downward (in the figure) from the top of the operation knob 52. A first rib 52*c* is formed at the left side (in the figure) of the boss 52*b*, and a second rib 52*d* is formed at the right side (in the figure) of the boss 52*b*.

The plunger 53 which is supported so as to be movable up and down with respect to the boss 52*b* is disposed below the boss 52*b*. The plunger 53 is elastically urged downward by a spring 54 accommodated in the boss 52*b* and the plunger 53, so that the contact 53*a* (in a lower portion of the figure) is elastically in contact with the cam face 51*d* of the housing 51.

In addition, in the first guide part 51*b* which faces the first rib 52*c* of the operation knob 52, a first switch operating member 55 which is formed in a rod shape elongated in the vertical direction (in the figure) is supported to be movable in the vertical direction. A rod shaped second switch operating member 56 is supported to be movable in the vertical direction in the second guide part 51*c* which faces the second rib 52*d* of the operation knob 52.

Lower portions of the first and second switch operating members 55 and 56 have large areas so as to be in contact with first and second switch mechanisms 57 and 58, respectively.

In the first and second switch mechanisms 57 and 58, dome shaped hollow parts are formed by a rubber sheet 59 having elasticity, and movable contacts 57*a* and 58*a* are formed on a ceiling of the hollow part. Fixed contacts 60*a* and 60*b* are formed on a printed board 60 which faces the movable contacts 57*a* and 58*a*.

The bottom of the housing 51 is shielded by a shielding plate 61 so as to shield the hollow inside of the housing 51.

An operation of the switch device according to the related art is as follows. When the gripper 52*a* of the operation knob 52 is pressed downward, the first rib 52*c* presses the first switch operating member 55 so as to push the first switch mechanism 57 downward. Then, the rubber sheet 59 is elastically deformed so that the movable contact 57*a* is brought into contact with the fixed contact 60*a* and a first switch circuit is operated, and thus, for example, a window glass of an automobile moves down. At this time, the plunger 53 rotates so that the contact 53*a* moves to the right (in the figure) on the cam face 51*d* formed on the upper wall 51*a*, and thus click feelings are created corresponding to the shape of the cam face 51*d*.

In addition, when the gripper 52*a* of the operation knob 52 is pulled upward, the second rib 52*d* presses the second switch operating member 56 so as to push the second switch mechanism 58 downward.

Then, the movable contact 58*a* is brought into contact with the fixed contact 60*b* so that a second switch circuit is operated, and thus the window glass which has moved down moves upward.

At this time, the plunger 53 rotates so that the contact 53*a* moves to the left (in the figure) on the cam face 51*d*, and thus click feelings are created.

However, since the above-described switch device according the related art has a structure in which the first and second switch mechanisms 57 and 58 are disposed in the housing 51, the cam face is formed on the upper wall 51*a*, and the first and second switch operating members 55 and 56 formed in a rod shape elongated in the vertical direction push the first and second switch mechanisms 57 and 58, the height dimension thereof becomes large, which leads to a large appearance.

When clicking feelings are made different in order to form the cam face 51*d* integrally with the housing 51, it is necessary that the entire housing 51 be made again, and the click feelings cannot be easily changed. In addition, the housing 51 made of a resin material has large shrinkage in various dimensions due to variations of molding conditions of large components or the like. Therefore, each dimension is likely to have variations. When the guide parts 51*b* and 51*c* that support the switch operating members 55 and 56 are deformed, the switch operating members 55 and 56 do not slide smoothly, thereby causing variations in operation feeling.

Further, since the cam face 51*d* varies in shape, the click feelings vary. Therefore, for example, when a plurality of switch devices, corresponding to each window of seats of an automobile, is provided in a power window switch unit on the side of a driver's seat, the variations become a big problem.

SUMMARY OF THE INVENTION

An advantage of the invention is that it solves the above-described problems and provides a switch device which can be miniaturized in a height direction and can easily change click feelings while preventing operation feelings from varying.

In order to solve the problems, according to an aspect of the invention, a switch device includes: an operation knob rockably supported by a case; and a switch mechanism which can operate a switch circuit disposed inside the case by performing a rocking operation on the operation knob. A cam member having a cam face which can deliver click feelings to the operation knob is separately disposed inside the case. The switch circuit is operated and click feelings are created so as to be delivered to the operation knob, in conjunction with the rocking operation of the operation knob.

Further, preferably, the operation knob is disposed on an upper wall of the case, the cam member is disposed on an inner top surface of the upper wall, and the switch circuit is provided at a side facing the top surface of the case.

Furthermore, preferably, at least a pair of the switch mechanisms is formed on a switch board disposed inside the case so as to face the cam member. A switch operating member is supported by the cam member, the switch operating member being able to operate one of the switch mechanisms in conjunction with the rocking operation of the operation knob.

In addition, preferably, a rocking support part which can be supported by the case and an operation shaft which extends to the cam member disposed inside the case from the vicinity of the rocking support part are formed in the operation knob. Further, an engaging part is formed in the operation shaft, the engaging part being able to be engaged with a portion of the switch operating member so as to rotate the switch operating member supported by the cam member.

Further, preferably, a sliding contact member which can be slidably in contact with the cam face by an elastically urging force is sustained by the operation shaft. In addition, when the rocking operation is performed on the operation knob, the operation shaft tilts so that the sliding contact member is slidably in contact with the cam face, and thus the click feelings are delivered to the operation knob and the switch operating member rotates, thereby operating the switch circuit of the switch mechanism.

Furthermore, preferably, the switch operating member has a pair of clamping walls facing each other with the operation shaft of the operation knob interposed therebetween, and a slide support part which can be slidably engaged with the engaging part formed in the operation shaft is formed in the pair of clamping walls. Further, when the rocking operation is performed on the operation knob so as to tilt the operation shaft, the slide support part slides the engaging part, and thus the switch operating member rotates.

In addition, preferably, the switch operating member has a base which integrates the pair of clamping walls. In the base, preferably, a pair of rotatable support parts which can be rotatably engaged with a first engaging part formed in the cam member is formed in the base, and a pair of parts each of whose center is respectively provided with the rotatable support part and an extending part which connects the ends of the parts are formed, and the switch mechanisms are respectively disposed at lower sides, facing the extending part, of one and the other sides of the base. Further, the extending part of the base can operate each of the switch mechanisms when the switch operating member rotates around the rotatable support part serving as a fulcrum.

Moreover, preferably, the sliding member is composed of a steel ball which can be slidably in contact with the cam face.

Further, preferably, the cam face of the cam member is formed in a plate shaped wall part having a predetermined thickness, and the wall part is engaged with a support groove formed inside the case so as to support the cam member.

Furthermore, preferably, two sets (four in total) of the switch mechanisms are respectively formed at lower sides, facing the extending part of the base, of one and the other sides of the switch operating member. In addition, preferably, one of the two switch mechanisms is operated by one of the extending parts as a first rocking operation is performed, and the other one of the two switch mechanisms is operated by performing a second rocking operation whose rocking amount is larger than that of the first rocking operation.

In addition, preferably, a concave part and a stepped part are formed on the cam face of the cam member, the concave part being able to create a first click feeling corresponding to the first rocking operation of the operation knob and the stepped part being able to create a second click feeling corresponding to the second rocking operation.

Further, preferably, the cam member is provided with a second engaging part which can be engaged with an engaging protrusion formed inside the case, and the cam member is engaged with the case by engaging the second engaging part with the engaging protrusion.

The cam member having the cam face which can deliver click feelings to the operation knob is disposed in the case of the switch device of the invention. The switch circuit is operated in conjunction with the rocking operation of the operation knob, and click feelings are created so as to be delivered to the operation knob. Therefore, the switch mechanism and the cam member can be disposed so as to overlap each other by disposing the cam member in the case, the height can become small, and thus it is possible to provide a miniaturized switch device.

In addition, the click feeling can vary easily only by changing the cam member. By forming the cam member and the switch operating member separately from the case having a large size, a stable operation can be obtained.

The cam member is disposed on the inner top surface of the upper wall of the case. Therefore, for example, when the switch circuit is covered by a rubber sheet, a reliable waterproof structure can be obtained since a hole does not need to be formed by punching through the rubber sheet, as compared with a structure in which the cam member protrudes from the switch circuit.

Further, at least a pair of the switch mechanisms is formed on the switch board disposed inside the case so as to face the cam member, a switch operating member is supported by the cam member, and the switch operating member can operate one of the switch mechanisms in conjunction with the rocking operation of the operation knob. Therefore, at least a pair of the switch mechanisms can be operated by one switch operating member, and thus it is possible to provide a switch device having a small number of components.

By supporting the separate switch operating member in the cam member, accurate relationships between the height of the cam face and the location by which the switch mechanism is pressingly operated can be improved, and thus it is possible to easily make the click feelings in conjunction with the switch operation.

Furthermore, the rocking support part which can be supported by the case, and the operation shaft which extends to the cam member disposed inside the case from the vicinity of the rocking support part are formed in the operation knob. Further, the engaging part is formed in the operation shaft and the engaging part can be engaged with a portion of the switch operating member so as to rotate the switch operating member supported by the cam member. Therefore, when the operation shaft is tilted by the rocking operation of the operation knob, the switch operating member can reliably rotate so as to operate the switch mechanism.

Further, when the rocking operation is performed on the operation knob, the operation shaft tilts so that the sliding contact member is slidably in contact with the cam face, and thus the click feelings are delivered to the operation knob and the switch operating member rotates, thereby operating the switch circuit of the switch mechanism. Therefore, as the click feelings are delivered to the operation knob, the conversion of the switch circuit of the switch mechanism can be detected, which improves operability.

Furthermore, the switch operating member has a pair of clamping walls which face each other with the operation shaft of the operation knob interposed therebetween, and a slide support part which can be slidably engaged with the engaging part formed in the operation shaft is formed in the pair of clamping walls. In addition, when the rocking operation is performed on the operation knob so as to tilt the operation shaft, the slide support part slides the engaging part, and thus the switch operating member rotates. Therefore, the switch operating member can rotate smoothly, and thus the switch mechanism can be reliably operated.

Further, the switch operating member has the base which integrates the pair of clamping walls, and in the base, a pair of the rotatable support parts which can be rotatably engaged with the first engaging part formed in the cam member is formed and a pair of the parts each of which center is respectively provided with the rotatable support part and the extending part which connects the ends of the parts are formed. In addition, the switch mechanisms are respectively disposed at lower sides, facing the extending part, of one and the other sides of the base, and the extending part of the base can operate each of the switch mechanisms when the switch operating member rotates around the rotatable support part serving as a fulcrum. Therefore, a further reliable switch operation can be performed.

Since the sliding member is composed of a steel ball which can be slidably in contact with the cam face, the friction resistance between the sliding member and the cam face decreases, which improves operability.

Further, the cam face of the cam member is formed in the plate shaped wall part having a predetermined thickness, and the wall part is engaged with the support groove formed inside the case so as to support the cam member. Therefore, the wall part is prevented from being deformed by the support groove, and the thickness of the cam member can be made slim, which enables miniaturization.

Furthermore, two sets (four in total) of the switch mechanisms are respectively formed at lower sides, facing the extending part of the base, of one and the other sides of the switch operating member. In addition, one of the two switch mechanisms is operated by one of the extending parts as the first rocking operation is performed, and the other one of the two switch mechanisms is operated by performing the second rocking operation whose rocking amount is larger than that of the first rocking operation. Therefore, it is possible to operate four switch mechanisms by using one switch operating member, which improves operability.

The concave part and the stepped part are formed on the cam face of the cam member, the concave part can create the first click feeling corresponding to the first rocking operation of the operation knob, and the stepped part can create the second click feeling corresponding to the second rocking operation. Therefore, the first and the second click feelings can be reliably created with high accuracy so as to be delivered to the operation knob.

The cam member is provided with the second engaging part which can be engaged with the engaging protrusion formed inside the case, and the cam member is engaged with the case by engaging the second engaging part with the engaging protrusion, which improves assembling properties.

DESCRIPTION OF THE PREFERRED EMBODIMENT

Figure 1:
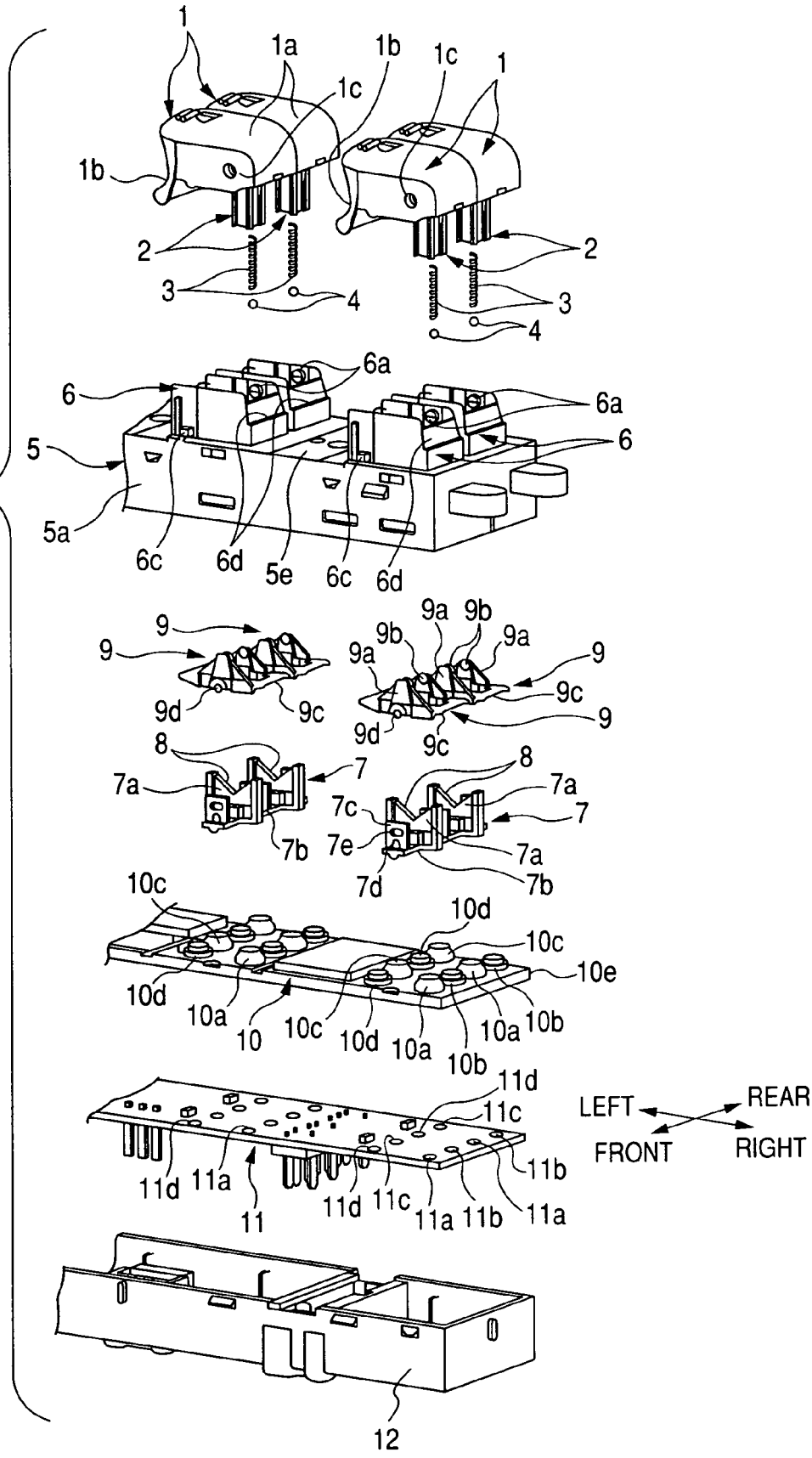
FIG. 1 is an exploded perspective view of a switch device of the invention.
Figure 2:
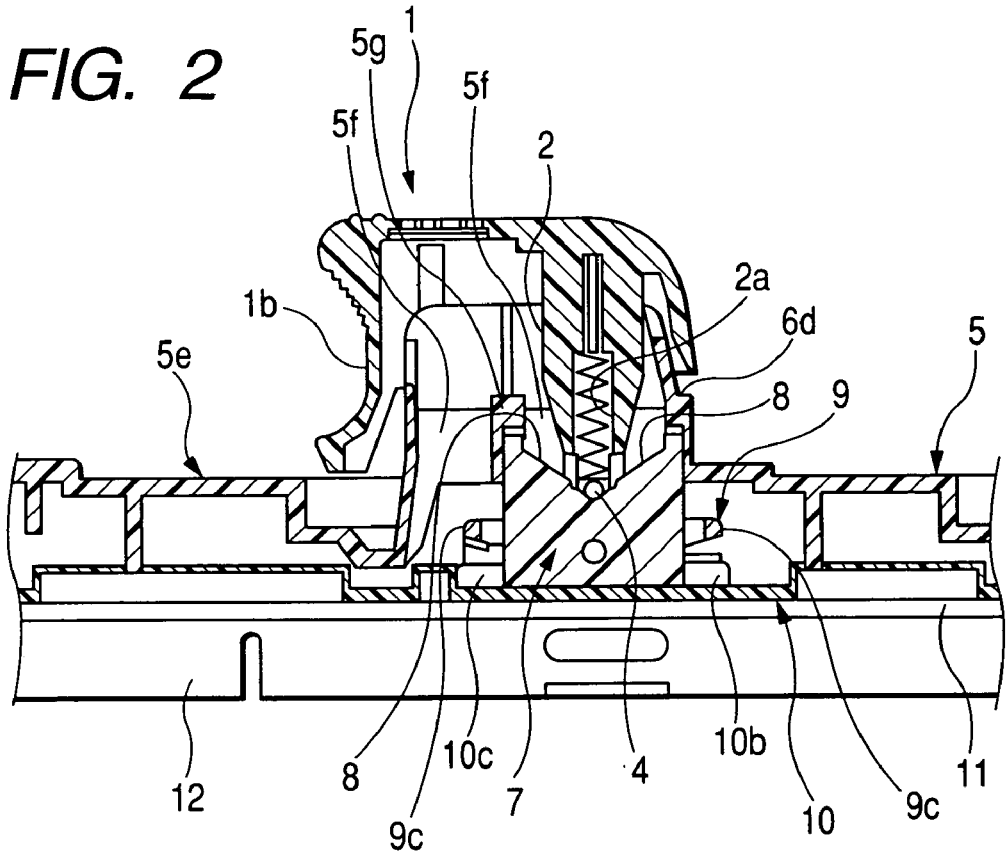
FIG. 2 is a cross sectional view of essential parts showing relations between an operation knob and a cam member according to the invention.
Figure 3:
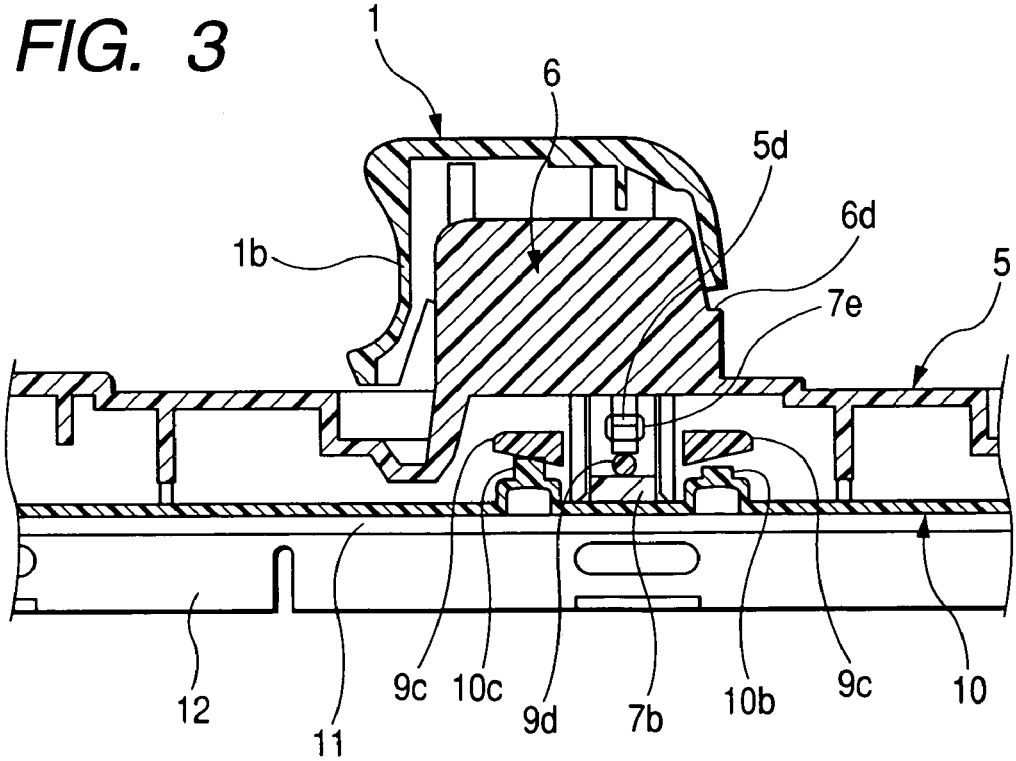
FIG. 3 is a cross sectional view of essential parts showing relations between the operation knob and a switch operating member according to the invention.
Figure 4:
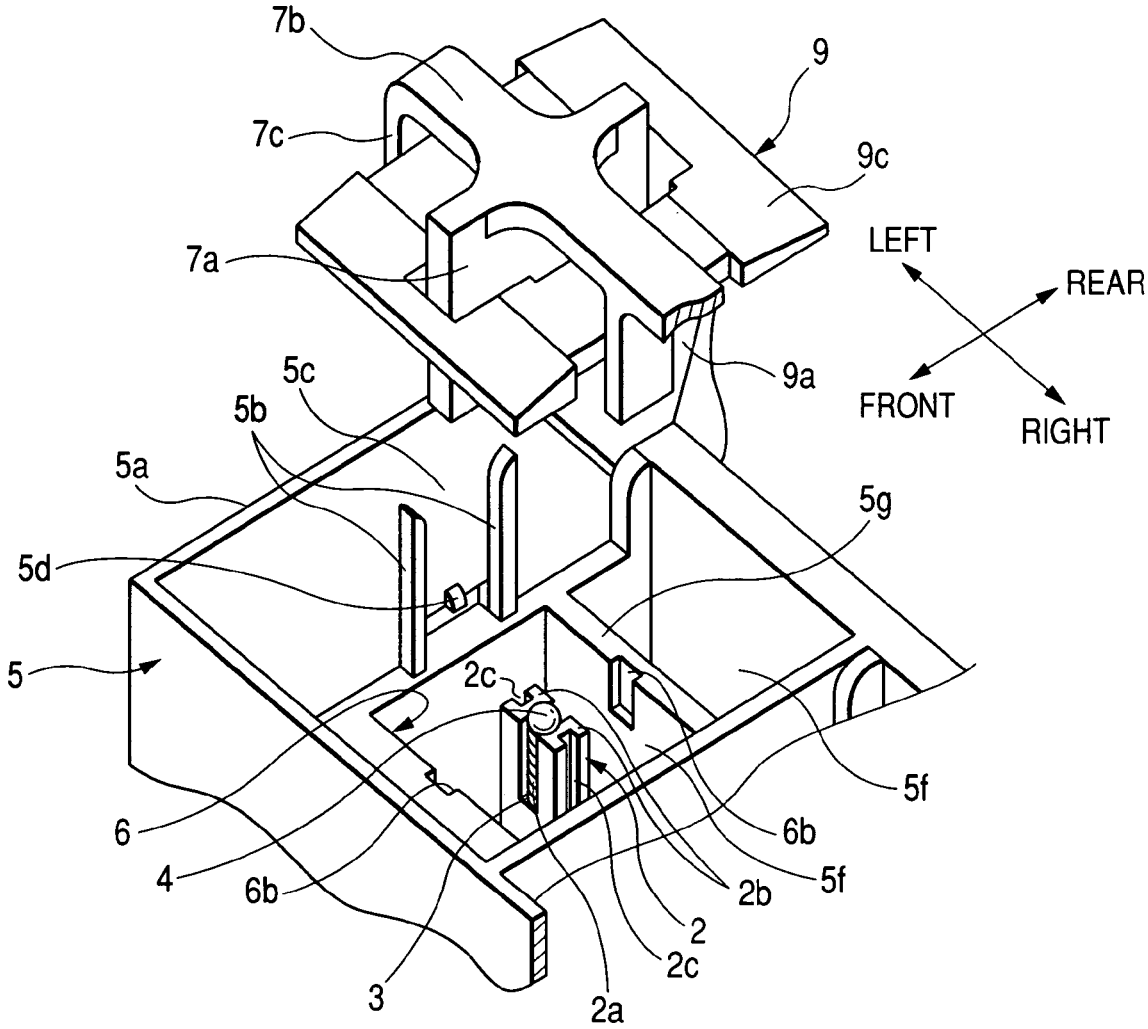
FIG. 4 is a perspective view of essential parts taken from the bottom showing an assembly of the switch operating member and the cam member according to the invention.
Figure 5:
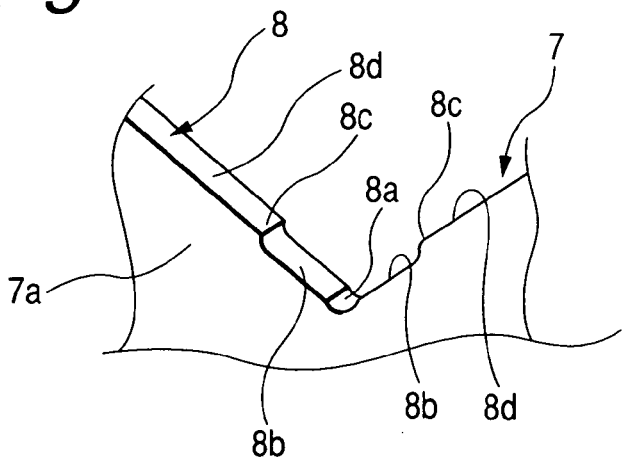
FIG. 5 is a perspective view of essential parts showing a cam face of the cam member according to the invention.
Figure 6:
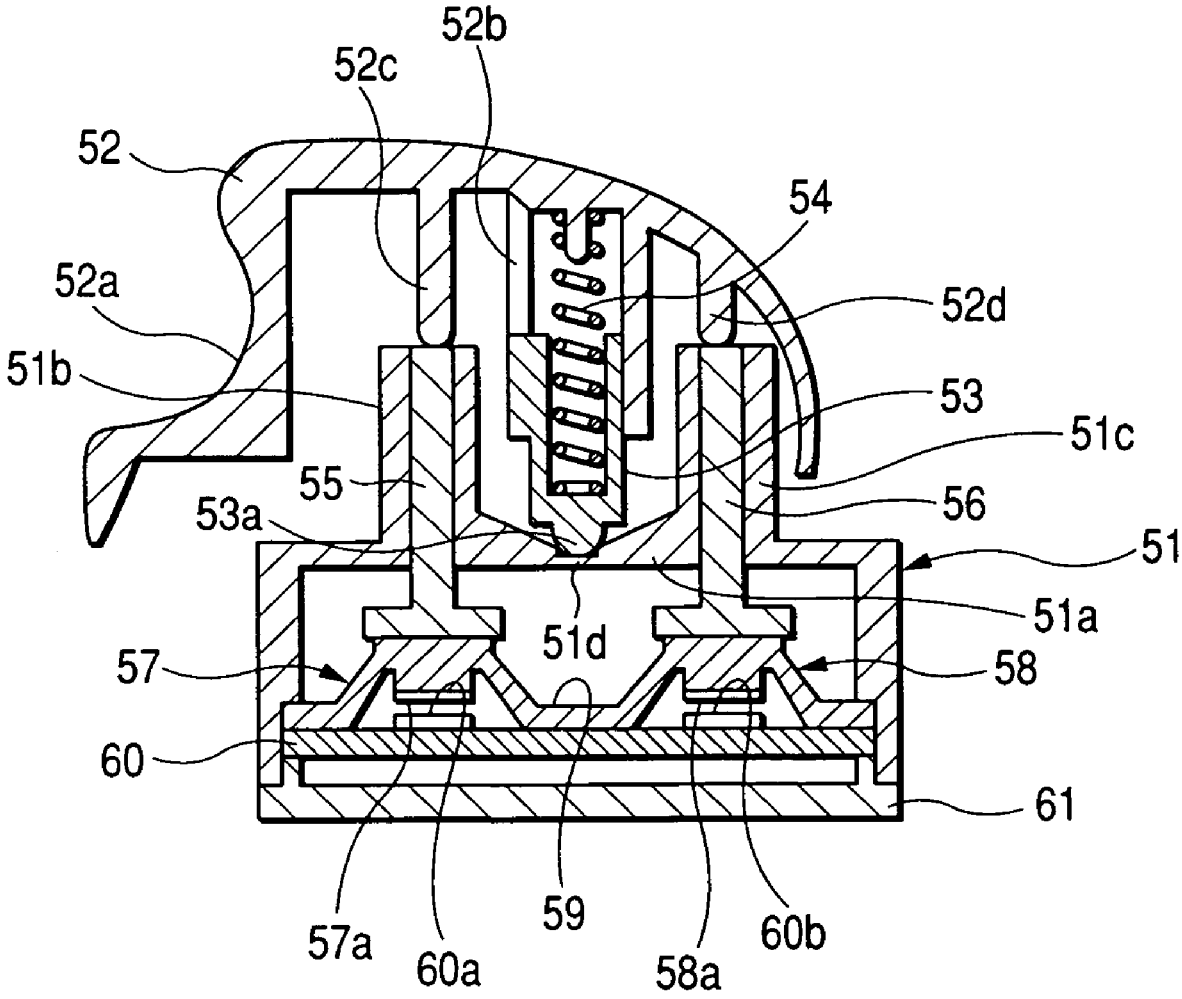
FIG. 6 PRIOR ART
FIG. 6 is a cross sectional view showing a switch device according to the related art.

Hereinafter, a switch device, for example, used for a power window switch of an automobile will be described with reference to the accompanying drawings. FIG. 1 is an exploded perspective view of the switch device of the invention. FIG. 2 is a cross sectional view of essential parts showing a relationship between an operation knob and a cam member according to the invention. FIG. 3 is a cross sectional view of essential parts showing a relationship between the operation knob and a switch operating member according to the invention. FIG. 4 is a perspective view of essential parts taken from the bottom showing an assembly of the switch operating member and the cam member according to the invention. FIG. 5 is a perspective view of essential parts showing a cam face of the cam member according to the invention.

As shown in FIG. 1, in the switch device of the invention, a plurality of operation knobs 1 is disposed in the uppermost portion, an operation part 1*b* which can be operated with fingers is formed around the left end (in the figure) of the a main body part 1*a*, a rocking support part 1*c* is formed around the right end (in the figure). A prismatic operation shaft 2 is formed to extend downward from the vicinity of the rocking support part 1*c* of the main body part 1*a*.

As shown in FIG. 4, in the operation shaft 2, a slitting groove 2*a* is formed from the front end of the operation shaft 2 with a predetermined depth. A pair of operation parts 2*b* and 2*b* is formed at the front end side of the operation shaft 2 by the slitting groove 2*a*. An engaging part 2*c* composed of a groove having predetermined width and depth is formed on an external wall of the operation parts 2*b* and 2*b*.

The slitting groove 2*a* accommodates a coil spring 3 and a sliding member 4 composed of a steel ball disposed therein. That is, the sliding member 4 is urged by the urging force of the coil spring 3 in a direction jumping out of the slitting groove 2*a*.

The operation knob 1 is disposed such that the rocking support part 1*c* is supported by a supporting protrusion 6*a* of a knob support part 6 formed on a case 5. In the operation knob 1 which allows the rocking support part 1*c* to be supported by the supporting protrusion 6*a*, when the operation shaft 2 is positioned in a hollow inner portion of the case 5 and the operation part 1*b* is rockably operated up and down with respect to the rocking support part 1*c* serving as a fulcrum, the operation shaft 2 can be tilted.

The case 5 includes an upper wall 5*e*, a side plate 5*a*. The knob support part 6 is formed on an external surface of the upper wall 5*e*, and the side plate 5*a* is formed below the periphery of the upper wall 5*e*. On an inner surface of the side plate 5*a*, a first cam support groove 5*c* is formed between a pair of protrusions 5*b* and 5*b* which can support a cam member 7 to be described below, and an engaging protrusion 5*d* is formed to protrude from the first cam support groove 5*c*.

As shown in FIG. 2, in the case 5, a through hole 5*f* which penetrates the upper wall 5*e* in a vertical direction is formed in the upper wall 5*e* located inside the knob support part 6, and a cam support groove forming wall 5*g* is formed on the upper wall 5*e*.

As shown in FIG. 4, in the case 5, a second cam support groove 6*b* having a groove shape is formed on an inner surface of the upper walls 5*e* which face each other in a hollow inner portion of the knob support part 6. With the upper wall 5*e* and the side plate 5*a*, the case 5 is formed substantially in a box shape such that an accommodating space is formed therein.

Further, the cam member 7 shown in FIG. 1 is supported by the first and the second cam support grooves 5*c* and 6*b* shown in FIG. 4. The cam member 7 is made of a resin material and is integrally formed by connecting a pair of wall parts 7*a* facing each other with a predetermined interval through a base part 7*b*.

In a support part 7*c* formed to protrude from both ends of the base part 7*b* in a length direction, a first engaging part 7*d* and a second engaging part 7*e* are formed. A rotatable support part 9*d* of a switch operating member 9 to be described later can be engaged with the first engaging part 7*d* by a snap-in operation. The engaging protrusion 5*d* of the case 5 can be engaged with the second engaging part 7*e* by a snap-in operation.

The first engaging part 7*d* and the second engaging part 7*e* are formed of a through hole. However, the concavo-convex relationship therebetween may be opposite.

In the cam member 7, each of the wall parts 7*a* is formed in a thin plate shape, and an inverted triangle shaped cam face 8 is formed on the top face of the wall part 7*a*.

As shown in FIG. 5, in the cam face 8, a concave part 8*a* in which the siding member 4 composed of a steel ball can be positioned is formed at an inverted triangle shaped lower portion, and an inclined first cam face 8*b* extending to the concave part 8*a* is formed.

Further, a stepped part 8*c* having a predetermined height is formed on the first cam face 8*b* which is positioned a predetermined distance away from the concave part 8*a*, and a second cam face 8*d* is formed above the stepped part 8*c*. The first cam face 8*b* is connected to the second cam face 8*d* through the stepped part 8*c*.

The operation knob 1 in a non-operative state is positioned in a neutral state, in which the sliding member 4 is positioned in the concave part 8*a* by the urging force of the coil spring 3. By performing a first rocking operation of the operation part 1*b* of the operation knob 1 in one direction, the sliding member 4 escapes from the concave part 8*a* so as to be positioned on the first cam face 8*b*, and a first click feeling is created.

In addition, by performing a second rocking operation of the operation knob 1 whose rocking amount is larger than that of the first rocking operation, the sliding member 4 jumps over the stepped part 8*c* onto the second cam face 8*d* from the first cam face 8*b*, and thus a second click feeling is created.

The knob support part 6 of the case 5 is provided with a first stopper part 6*c* at the left side of the figure, and is provided with a second stopper part 6*d* at the right side in the figure. As the main body 1*a* of the operation knob 1 which is rockably operable is brought into contact with the fist stopper part 6*c* and the second stopper part 6*d*, the operation knob 1 stops rocking.

As shown in FIG. 1, in the cam member 7, a switch operating member 9 having a pair of triangle shaped clamping walls 9*a* and 9*a* is disposed between the wall parts 7*a*.

The switch operating member 9 is made of a resin material, and a slide support part 9*b* is formed on the top of the triangle shaped clamping walls 9*a* to protrude inward. The slide support part 9*b* can be engaged with the groove shaped engaging part 2*c* of the operation shaft 2 and slide along the engaging part 2*c*.

The concavo-convex relationship between the engaging part 2*c* and the slide support part 9*b* can be opposite.

The lower portion of the pair of clamping walls 9*a* which face each other is integrally connected to a base 9*c*.

A pair of rotatable support parts 9*d* which is capable of being engaged with the first engaging part 7*d* of the cam member 7 is formed to protrude from the base 9*c* of the switch operating member 9. The base 9*c* is formed by a pair of parts whose center is respectively provided with the rotatable support part 9*d*, and a pair of extending parts which connect the ends of the parts.

One side and the other side of the extending part of the base 9*c* is designed to be capable of operating first to fourth switch mechanisms 10*a* to 10*d*.

That is, in the switch operating mechanism 9, when the rotatable support part 9*d* is supported by the first engaging part 7*d* of the cam member 7, the wall part 7*a* of the cam member 7 is positioned between the pair of clamping walls 9*a* and 9*a*, and the base 9*c* can pivot on the rotatable support part 9*d* serving as a fulcrum.

When the operation shaft 2 is tilted by rockably operating the operation knob 1 as the engaging part 2*c* of the operating shaft 2 is slidably engaged with the slide support part 9*b*, the base 9*c* of the switch operating member 9 rotates in the clockwise or counter-clockwise direction.

As shown in FIG. 4, in the cam member 7 which is combined with the switch operating member by supporting the rotatable support part 9*d* of the switch operating member 9, both ends (front and rear direction in the figure) of the wall part 7*a* join with the second cam support groove 6*b*, and the support parts 7*c* on the left and right sides in the drawing join with the first cam support groove 5*c*. Thus, the second engaging part 7*e* formed in the support part 7*c* is engaged with the engaging protrusion 5*d* by a snap-in operation, and the cam member 7 is prevented from slipping out of the case 5.

In addition, as shown in FIG. 1, a rubber sheet 10 made of silicon rubber is disposed below the cam member 7 which is in a state engaged by the snap-in operation inside the case 5.

In the rubber sheet 10, on a portion which the base 9*c* at one side (right side in FIG. 1) of the switch operating member 9 faces, the dome shaped first switch mechanism 10*a* which is formed to protrude therefrom and the second switch mechanism 10*b* whose protrusion height is smaller than that of the first switch mechanism 10*b* are adjacently formed in a front and rear direction respectively in FIG. 1.

In addition, the front, rear, left and right directions shown in FIGS. 1 and 4 indicate different directions, respectively; however, each direction is set in every drawings in order to explain conveniently.

In the rubber sheet 10, on a portion which the base 9*c* at the other side (left side in FIG. 1) of the switch operating member 9 faces, the third switch mechanism 10*c* having the same protrusion height as that of the first switch mechanism 10*a*, and the fourth switch mechanism 10*d* having the same protrusion height as that of the second switch mechanism 10*b* are adjacently formed in the front and rear direction respectively in FIG. 1.

The outer peripheral side of the rubber sheet 10 is surrounded by a peripheral wall 10*e*, and the peripheral wall 10*e* is designed to cover a switch board 11.

Conductive ink is printed on the surface of ceilings of the dome shaped first to fourth switch mechanisms 10*a* to 10*d* of the rubber sheet 10, so that movable contacts (not shown) are formed in the same manner as in the related art.

The rubber sheet 10 is mounted on the plate shaped switch board 11. First to fourth fixed contacts (switch circuits) 11*a* to 11*d* are formed on portions of the top surface of the switch board 11 which the movable contacts of the first to fourth switch mechanisms 10*a* to 10*d* face.

Since the top surface and the side surface of the switch board 11 are covered by the rubber sheet 10, it is possible to realize a waterproof structure in which liquid can not permeate into the top surface of the switch board 11 even when liquid such as water permeates through the upper portion of the rubber sheet 10 is achieved.

The switch board 11 can be mounted on a cover 12 which is disposed below the switch board 11, and the cover 12 having the switch board 11 mounted thereon can be integrated with the case 5 by a snap-in engagement.

An operation of the switch device of the invention having the above mentioned structure will be described. First, if the first rocking operation is performed on one operation part 1*b* of one operation knob 1 among the plural operation knobs 1, for example, by unidirectionally pushing the operation part 1*b* downward when the operation knob 1 is in a neutral state, that is, when the sliding member 4 is positioned in the concave part 8*a* which is the center of the cam face 8, the operation knob 1 rotates in the counter-clockwise direction around the rocking support part 1*c* serving as a fulcrum, and the operation shaft 2 is tilted in the counter-clockwise direction, and thus the sliding member 4 composed of a steel ball which was positioned in the concave part 8*a* moves onto the first cam face 8*b* shown at the right side in FIG. 5. Further, accompanying to the tilting of the operation knob 1, the coil spring 3 is pressed to be shortened.

At this time, when the sliding member 4 moves from the concave part 8*a* onto the first cam face 8*b*, the first click feeling is created so as to be delivered to the operation knob 1 by the urging force of the coil spring 3. at the same time, the slide support part 9*b* of the switch operating member 9 to be engaged with the engaging part 2*c* of the operation shaft 2 slides, and the switch operating member 9 rotates around the rotatable support part 9*d* serving as a fulcrum.

Accordingly, the portions of the base 9*c* at one side (right side in FIG. 1) of the switch operating member 9 press the first switch mechanism 10*a* having a larger height than the others, the movable contact of the first switch mechanism 10*a* is brought into contact with the first fixed contact 11*a*, thereby operating the first switch circuit.

As the first switch circuit is operated, for example, a window glass at the driver's seat side can be manually operated at the front seat side in order to move the window glass down to a desired location. In addition, by performing the second rocking operation whose rocking amount is larger than that of the first rocking operation on the operation knob 1, the sliding member 4 moves onto the second cam face 8*d* from the first cam face 8*b*, and the one side of the base 9*c* presses the second switch mechanism 10*b*, thus operating the second switch circuit. Further, while the first rocking operation is operated to the second rocking operation, the sliding member 4 climbs over the stepped part 8*c*, and the click feelings are created at this time.

As the second switch circuit is operated, for example, a window glass of an automobile can be automatically operated to move the window glass down to the lowest location.

In addition, while performing the second rocking operation, the operation knob 1 is in contact with the stopper part 6*c*. When the stopper part 6*c* is released from the operation knob 1, the operation knob 1 returns to the neutral position mainly by the urging force of the coil spring 3 or the dome shaped part of the rubber sheet.

When a third rocking operation is performed on the operation part 1*b* of the operation knob 1 by pulling up the operation part 1*b*, the operation knob 1 rocks in the clockwise direction with respect to the rocking support part 1*c* serving as a fulcrum, and the operation shaft 2 rocks in the clockwise direction as well, so that the sliding member 4 made of a steel ball positioned in the concave part 8*a* moves onto the first cam face 8*b* on the lefts side in FIG. 5. Thus, the first click feeling is delivered to the operation knob 1.

In this way, as the slide support part 9*b* of the switch operating member 9 slides inside the engaging part 2*c* of the operation shaft 2, the switch operating member 9 rotates in the counter-clockwise direction on the rocking support part 9*d* serving as a fulcrum.

Thereby, portions of the base 9*c* at the other side of the switch operating member 9 press the third switch mechanism 10*c* having a larger height than the others, and thus the third switch circuit is operated.

As the third switch circuit is operated, for example, a window glass which has been lowered can be manually operated in order to move the window glass up to a desired location. Click feelings composed of the first and second click feeling can be varied by only changing the depth of the concave part 8*b* and the height of the stepped part 8*c* of the cam member 7, and thus it is possible to easily change the click feelings.

By performing a fourth rocking operation whose rocking amount is larger than that of the third rocking operation on the operation knob 1, portions of the base 9*c* at the other side press the fourth switch mechanism 10*b*, thereby operating the fourth switch circuit.

As the fourth switch circuit is operated, for example, a window glass of an automobile which has been lowered can be automatically operated to move the window glass up to the highest location.

Since the creation of the click feelings and the return in the third and fourth rocking operations are as same as those in the first and second rocking operations, a detailed description will be omitted.

The operation knob is brought into contact with the fist stopper part 6*c* in the case of the above-mentioned downward operation, whereas the operation knob is brought into contact with the second stopper part 6*d* in the case of an upward operation.

Although the cam member 7 is fixed by being engaged with the case 5 by the snap-in operation in the embodiment, the cam member 7 is prevented from rattling since the cam member 7 is constantly urged by the coil spring 3.

Although the invention has described the structure and the operation of one operation knob 1 among the plural operation knobs 1, the rest of the operation knobs 1 have the same structure and usage.

Further, even though the invention has been described by using the first to fourth switch mechanisms 10*a* to 10*d*, the switch mechanisms 10*b* and 10*d* may be removed and at least a pair of switch mechanisms may be formed on the switch board 1 disposed inside the case 5 to face the cam member 7 and the upper wall 5*e*.

In this case, the cam member 7 may be formed such that only the first cam face 8*b* is formed left and right sides thereof with the concave part 8*a* interposed therebetween so as to create only the first click feeling.

The invention claimed is:

1. A switch device, comprising:

an operation knob rockably supported by a case; and a switch mechanism which can operate a switch circuit disposed inside the case by performing a rocking operation with the operation knob, wherein a cam member having a cam face which can deliver click feelings to the operation knob is separately disposed inside the case, and in conjunction with the rocking operation of the operation knob, the switch circuit is operated and click feelings are created so as to be delivered to the operation knob wherein the operation knob is disposed on an upper wall of the case, the cam member is disposed on an inner top surface of the upper wall, and the switch circuit is provided at a side facing a top surface of the case, and wherein at least a pair of switch mechanisms is formed on a switch board disposed inside the case so as to face the cam member, the switch board being located at a side facing the top surface of the case, and a switch operating member is supported by the cam member, the switch operating member being able to operate one of the switch mechanisms in conjunction with the rocking operation of the operation knob.

2. The switch device according to claim 1, wherein the cam face of the cam member is formed in a plate shaped wall part having a predetermined thickness, and the plate shaped wall part is engaged with a support groove formed inside the case so as to support the cam member.

3. The switch device according to claim 1, wherein the cam member is provided with a second engaging part which can be engaged with an engaging protrusion formed inside the case, and the cam member is engaged with the case by engaging the second engaging part with the engaging protrusion.

4. The switch device according to claim 1, wherein a rocking support part which is supported by the case and an operation shaft which extends to the cam member disposed inside the case from the vicinity of the rocking support part are formed in the operation knob, and an engaging part is formed in the operation shaft, the engaging part being able to be engaged with a portion of the switch operating member so as to rotate the switch operating member supported by the cam member.

5. The switch device according to claim 4, wherein a sliding contact member which can-be is slidably in contact with the cam face by an elastically urging force is sustained by the operation shaft, and when the rocking operation is performed on the operation knob, the operation shaft tilts so that the sliding contact member is slidably in contact with the cam face, and thus the click feelings are delivered to the operation knob and the switch operating member rotates, thereby converting the switch circuit of the switch mechanism.

6. The switch device according to claim 5, wherein the switch operating member has a pair of clamping walls facing each other with the operation shaft of the operation knob interposed therebetween, and a slide support part which can be slidably engaged with the engaging part formed in the operation shaft is formed in the pair of clamping walls, and when the rocking operation is performed on the operation knob so as to tilt the operation shaft, the slide support part slides the engaging part, and thus the switch operating member rotates.

7. The switch device according to claim 6, wherein the switch operating member has a base which integrates the pair of clamping walls, in the base, a pair of rotatable support parts which is rotatably engaged with a first engaging part formed in the cam member is formed, and a pair of parts are formed, and each of the parts is provided with the rotatable support part at its center and an extending part which connects ends of the parts are formed, the switch mechanisms are respectively disposed at lower sides, facing the extending part, of opposing sides of the base, and the extending part of the base can operate each of the switch mechanisms when the switch operating member rotates around the rotatable support part serving as a fulcrum.

8. The switch device according to claim 5, wherein the sliding member is composed of a steel ball which can be slidably in contact with the cam face.

9. The switch device according to claim 7, wherein two sets of the switch mechanisms are respectively formed at lower sides, facing the extending part of the base, of one and the other sides of the switch operating member, and one of the two switch mechanisms is operated by one of the extending parts as a first rocking operation is performed, and the other one of the two switch mechanisms is operated by performing a second rocking operation whose rocking amount is larger than that of the first rocking operation.

10. The switch device according to claim 9, wherein a concave part and a stepped part are formed on the cam face of the cam member, the concave part being able to create a first click feeling corresponding to the first rocking operation of the operation knob and the stepped part being able to create a second click feeling corresponding to the second rocking operation.

* * * * *

UNITED STATES PATENT AND TRADEMARK OFFICE

CERTIFICATE OF CORRECTION

PATENT NO. : 7,462,788 B2
APPLICATION NO. : 11/273536
DATED : December 9, 2008
INVENTOR(S) : Masao Miyauchi It is certified that error appears in the above-identified patent and that said Letters Patent is hereby corrected as shown below:

In the Claims

In column 11, claim 5, line 36, after "member which" delete "can-be".

Signed and Sealed this

Thirtieth Day of June, 2009

JOHN DOLL
*Acting Director of the United States Patent and Trademark Office*